US009447534B2

(12) United States Patent
Song et al.

(10) Patent No.: US 9,447,534 B2
(45) Date of Patent: Sep. 20, 2016

(54) LAUNDRY MACHINE

(75) Inventors: Jung Tae Song, Changwon-si (KR); Hyun Seok Seo, Changwon-si (KR); Soo Bong Kim, Changwon-si (KR); Ig Geun Kwon, Changwon-si (KR); Young Suk Kim, Changwon-si (KR); Hee Tae Lim, Changwon-si (KR); Min Gyu Jo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1055 days.

(21) Appl. No.: 13/142,986

(22) PCT Filed: Dec. 30, 2009

(86) PCT No.: PCT/KR2009/007963

§ 371 (c)(1),
(2), (4) Date: Sep. 13, 2011

(87) PCT Pub. No.: WO2010/077092

PCT Pub. Date: Jul. 8, 2010

(65) Prior Publication Data

US 2012/0024019 A1 Feb. 2, 2012

(30) Foreign Application Priority Data

| | | |
|---|---|---|
| Dec. 30, 2008 | (KR) | 10-2008-0136402 |
| May 28, 2009 | (KR) | 10-2009-0047192 |
| Aug. 27, 2009 | (KR) | 10-2009-0079950 |
| Dec. 30, 2009 | (KR) | 10-2009-0134031 |

(51) Int. Cl.
*D06F 37/20* (2006.01)
*D06F 37/22* (2006.01)

(52) U.S. Cl.
CPC ..... *D06F 37/20* (2013.01); *D06F 37/22* (2013.01)

(58) Field of Classification Search
CPC ..... D06F 37/20
See application file for complete search history.

(56) References Cited

U.S. PATENT DOCUMENTS

| | | | | |
|---|---|---|---|---|
| 1,593,678 | A | 7/1926 | Statler | |
| 2,856,699 | A | 10/1958 | Frey | |
| 3,275,152 | A | 9/1966 | Searle | 210/64 |
| 3,509,742 | A | 5/1970 | Bauer | 68/23.1 |
| 4,033,047 | A | 7/1977 | Kawai | 34/82 |
| 4,204,339 | A | 5/1980 | Muller | 34/75 |
| 4,891,892 | A | 1/1990 | Narang | 34/86 |
| 4,899,462 | A | 2/1990 | Putnam et al. | 34/19 |
| 5,231,805 | A | 8/1993 | Sander | 51/429 |

(Continued)

FOREIGN PATENT DOCUMENTS

| | | | |
|---|---|---|---|
| CN | 1179489 | A | 4/1998 |
| CN | 1208787 | A | 2/1999 |

(Continued)

OTHER PUBLICATIONS

Chinese Office Action dated Mar. 5, 2013 issued in Application No. 201080017293.4 (with English translation).

(Continued)

*Primary Examiner* — Jason Ko
(74) *Attorney, Agent, or Firm* — KED & Associates LLP

(57) ABSTRACT

A laundry machine is disclosed. The bearing housing and the suspensions may be distant from each other with respect to a radial direction as well as an axial direction of the shaft. As a result, the suspension unit may include a radial bracket extended radially or axial bracket extended axially.

12 Claims, 4 Drawing Sheets

(56) References Cited

U.S. PATENT DOCUMENTS

| | | | | |
|---|---|---|---|---|
| 5,259,218 | A | 11/1993 | Broadbent | 68/12.06 |
| 5,582,040 | A | 12/1996 | Khan | 68/23.2 |
| 5,735,006 | A | 4/1998 | Vande Haar | 8/158 |
| 6,256,823 | B1 | 7/2001 | Kronbetter et al. | 8/158 |
| 6,941,680 | B1 | 9/2005 | Zielewicz et al. | |
| 7,020,985 | B2 | 4/2006 | Casey et al. | |
| 7,020,986 | B1 | 4/2006 | Nakai et al. | |
| 7,168,274 | B2 | 1/2007 | Slutsky et al. | |
| 7,251,963 | B2 | 8/2007 | Kim et al. | 68/196 |
| 7,398,662 | B2 | 7/2008 | Kim et al. | 68/23 |
| 7,458,171 | B1 | 12/2008 | Lentz | |
| 8,028,439 | B2 | 10/2011 | Prajescu | |
| 8,201,345 | B2 | 6/2012 | Dalton et al. | |
| 8,256,137 | B2 | 9/2012 | Noviello et al. | |
| 8,438,750 | B2 | 5/2013 | Dittmer et al. | |
| 8,468,711 | B2 | 6/2013 | Kim et al. | |
| 8,490,294 | B2 | 7/2013 | Brunert | |
| 8,607,473 | B2 | 12/2013 | Choi et al. | |
| 8,615,895 | B2 | 12/2013 | Shin et al. | |
| 8,627,580 | B2 | 1/2014 | Kim et al. | |
| 8,627,581 | B2 | 1/2014 | Brown | |
| 8,661,707 | B2 | 3/2014 | Dittmer et al. | |
| 8,667,705 | B2 | 3/2014 | Shin et al. | |
| 8,800,165 | B2 | 8/2014 | Kwon et al. | |
| 8,863,401 | B2 | 10/2014 | Grunert et al. | |
| 8,984,767 | B2 | 3/2015 | Grunert et al. | |
| 8,997,377 | B2 | 4/2015 | Kim et al. | |
| 9,027,256 | B2 | 5/2015 | Kim et al. | |
| 9,051,679 | B2 | 6/2015 | Kwon et al. | |
| 9,103,063 | B2 | 8/2015 | Kwon et al. | |
| 9,194,073 | B2 | 11/2015 | Kwon et al. | |
| 9,200,837 | B2 | 12/2015 | Kwon et al. | |
| 9,200,838 | B2 | 12/2015 | Kwon et al. | |
| 9,255,353 | B2 | 2/2016 | Kwon et al. | |
| 9,284,677 | B2 | 3/2016 | Kwon et al. | |
| 2004/0107742 | A1 | 6/2004 | Kim et al. | 68/24 |
| 2004/0123631 | A1 | 7/2004 | Chang | |
| 2004/0148978 | A1 | 8/2004 | Kim et al. | 68/23 |
| 2004/0163426 | A1 | 8/2004 | Kim et al. | 68/23 |
| 2004/0221474 | A1 | 11/2004 | Slutsky et al. | 34/319 |
| 2004/0226321 | A1 | 11/2004 | Park et al. | 68/23.1 |
| 2004/0261469 | A1 | 12/2004 | Park et al. | 68/23 |
| 2005/0120715 | A1 | 6/2005 | Labrador | |
| 2005/0183472 | A1 | 8/2005 | Choi | 68/23.1 |
| 2005/0262879 | A1 | 12/2005 | Kim et al. | 68/3 |
| 2005/0274159 | A1 | 12/2005 | Jeon et al. | 68/23.1 |
| 2006/0010935 | A1 | 1/2006 | Park et al. | 68/3 |
| 2006/0016228 | A1 | 1/2006 | Chang et al. | 68/23.1 |
| 2006/0053838 | A1 | 3/2006 | Inuzuka et al. | 68/3 |
| 2006/0075791 | A1 | 4/2006 | Seo et al. | 68/23.1 |
| 2006/0101865 | A1 | 5/2006 | Jeon et al. | 68/3 |
| 2006/0169006 | A1 | 8/2006 | Lim et al. | 68/13 |
| 2006/0174663 | A1 | 8/2006 | Cimetta et al. | 68/3 |
| 2006/0174665 | A1 | 8/2006 | Namkung et al. | 68/140 |
| 2007/0051142 | A1 | 3/2007 | Lim et al. | 68/139 |
| 2007/0074543 | A1 | 4/2007 | Lim et al. | 68/140 |
| 2007/0227200 | A1 | 10/2007 | Kim et al. | 68/140 |
| 2007/0289339 | A1 | 12/2007 | Lim | 68/23.1 |
| 2008/0099052 | A1 | 5/2008 | Lee et al. | 134/18 |
| 2008/0264114 | A1 | 10/2008 | Jang et al. | 68/139 |
| 2008/0276656 | A1 | 11/2008 | Kitamura et al. | |
| 2008/0307833 | A1 | 12/2008 | Chang et al. | 68/23.1 |
| 2009/0056389 | A1 | 3/2009 | Pinkowski et al. | |
| 2009/0178442 | A1 | 7/2009 | Kawabata et al. | |
| 2009/0178445 | A1 | 7/2009 | Brinkmann | 68/23 |
| 2010/0306928 | A1 | 12/2010 | Kimm et al. | |
| 2011/0173834 | A1 | 7/2011 | Arrigoni et al. | 34/90 |
| 2012/0000087 | A1 | 1/2012 | Da Riol et al. | |
| 2012/0090189 | A1 | 4/2012 | Kwon et al. | |
| 2013/0091726 | A1 | 4/2013 | Kim et al. | |
| 2013/0139402 | A1 | 6/2013 | Hong | 34/427 |
| 2013/0205840 | A1 | 8/2013 | Hong et al. | |
| 2013/0219734 | A1 | 8/2013 | Kim et al. | |
| 2013/0255099 | A1 | 10/2013 | Cavarretta et al. | 34/108 |
| 2013/0263630 | A1 | 10/2013 | Doh et al. | |
| 2013/0291395 | A1 | 11/2013 | Doh et al. | |
| 2013/0318813 | A1 | 12/2013 | Hong et al. | |
| 2014/0150277 | A1 | 6/2014 | Kwon et al. | |
| 2014/0150279 | A1 | 6/2014 | Kwon et al. | |
| 2014/0208609 | A1 | 7/2014 | Han et al. | |

FOREIGN PATENT DOCUMENTS

| | | | |
|---|---|---|---|
| CN | 1508349 | A | 6/2004 |
| CN | 1511996 | A | 7/2004 |
| CN | 1540085 | A | 10/2004 |
| CN | 1548627 | A | 11/2004 |
| CN | 1707010 | A | 12/2005 |
| CN | 1724742 | A | 1/2006 |
| CN | 1730776 | A | 2/2006 |
| CN | 1730777 | A | 2/2006 |
| CN | 1730778 | A | 2/2006 |
| CN | 1814895 | A | 8/2006 |
| CN | 1844543 | A | 10/2006 |
| CN | 1906351 | A | 1/2007 |
| CN | 1940166 | A | 4/2007 |
| CN | 101046046 | A | 10/2007 |
| CN | 101173482 | | 5/2008 |
| CN | 101343826 | | 1/2009 |
| CN | 101381946 | A | 3/2009 |
| CN | 100513673 | C | 7/2009 |
| DE | 25 03 576 | A1 | 8/1976 |
| DE | 3438575 | A1 | 4/1986 |
| DE | 41 04 450 | A1 | 8/1992 |
| DE | 44 13 069 | A1 | 10/1994 |
| DE | 297 16 968 | U1 | 11/1997 |
| DE | 198 56 973 | A1 | 6/1999 |
| DE | 103 42 254 | B3 | 11/2004 |
| DE | 10 2006 012 035 | B3 | 3/2007 |
| DE | 10 2006 031 352 | A1 | 1/2008 |
| EP | 0 152 745 | A2 | 8/1985 |
| EP | 0 443 361 | A1 | 8/1991 |
| EP | 0 648 885 | A1 | 4/1995 |
| EP | 1 079 014 | A1 | 2/2001 |
| EP | 1 270 791 | A2 | 1/2003 |
| EP | 1 433 890 | A2 | 6/2004 |
| EP | 1 445 368 | A2 | 8/2004 |
| EP | 1 529 869 | A2 | 5/2005 |
| EP | 1 605 088 | A2 | 12/2005 |
| EP | 1 619 286 | A2 | 1/2006 |
| EP | 1 688 524 | A1 | 8/2006 |
| EP | 1 688 525 | A1 | 8/2006 |
| EP | 1 688 531 | A1 | 8/2006 |
| EP | 1 690 969 | A1 | 8/2006 |
| EP | 1 710 340 | A2 | 10/2006 |
| EP | 1 722 025 | A1 | 11/2006 |
| EP | 1 746 192 | A2 | 1/2007 |
| EP | 1 770 199 | A2 | 4/2007 |
| EP | 1 840 257 | A1 | 10/2007 |
| EP | 1 881 099 | A1 | 1/2008 |
| EP | 1 975 298 | A1 | 10/2008 |
| EP | 2 039 819 | A1 | 3/2009 |
| EP | 2 053 157 | A1 | 4/2009 |
| EP | 2 075 364 | A1 | 7/2009 |
| EP | 2 078 777 | A1 | 7/2009 |
| EP | 2 390 401 | A2 | 11/2011 |
| EP | 2 435 624 | A2 | 4/2012 |
| FR | 2 931 489 | A1 | 11/2009 |
| GB | 913801 | A | 12/1962 |
| GB | 1181797 | A | 2/1970 |
| GB | 2 091 123 | A | 7/1982 |
| GB | 2 279 968 | A | 1/1995 |
| JP | S52-131661 | A | 11/1977 |
| JP | H07-124382 | A | 5/1995 |
| JP | H07-275591 | A | 10/1995 |
| JP | H10-211393 | A | 8/1998 |
| JP | 2003-245489 | | 9/2003 |
| JP | 2004-000806 | A | 1/2004 |
| JP | 3502039 | B2 | 3/2004 |
| JP | 2006-061613 | A | 3/2006 |
| JP | 2007-282962 | A | 11/2007 |
| JP | 2008-006045 | A | 1/2008 |
| JP | 2008-259665 | A | 10/2008 |
| JP | 2009-028400 | A | 2/2009 |

(56) References Cited

FOREIGN PATENT DOCUMENTS

| | | | |
|---|---|---|---|
| JP | 2009-060990 | A | 3/2009 |
| JP | 2009-61217 | | 3/2009 |
| KR | 10-2000-0056255 | A | 9/2000 |
| KR | 10-2001-0071245 | A | 7/2001 |
| KR | 10-2002-0056323 | A | 7/2002 |
| KR | 10-2002-0091795 | A | 12/2002 |
| KR | 10-2003-0092185 | A | 12/2003 |
| KR | 10-2004-0046973 | A | 6/2004 |
| KR | 10-2005-0022659 | A | 3/2005 |
| KR | 10-2005-0006330 | A | 7/2005 |
| KR | 10-2005-0108609 | A | 11/2005 |
| KR | 10-2006-0009075 | A | 1/2006 |
| KR | 10-2006-0046969 | A | 5/2006 |
| KR | 10-2006-0095816 | A | 9/2006 |
| KR | 10-2006-0117528 | A | 11/2006 |
| KR | 10-0651853 | B1 | 12/2006 |
| KR | 10-2007-0059431 | A | 6/2007 |
| KR | 10-0730919 | B1 | 6/2007 |
| KR | 10-2007-0078602 | A | 8/2007 |
| KR | 10-2007-0101688 | | 10/2007 |
| KR | 10-2008-0002475 | A | 1/2008 |
| KR | 10-2008-0018747 | A | 2/2008 |
| KR | 10-0808192 | B1 | 2/2008 |
| KR | 10-2008-0072187 | A | 8/2008 |
| KR | 10-2008-0078328 | | 8/2008 |
| KR | 10-2008-0095565 | | 10/2008 |
| RU | 2 085 641 | C1 | 7/1997 |
| RU | 2 182 197 | C2 | 5/2002 |
| RU | 2 303 092 | C1 | 7/2007 |
| RU | 2 303 668 | C2 | 7/2007 |
| WO | WO 01/96647 | A1 | 12/2001 |
| WO | WO 2005/017249 | A1 | 2/2005 |
| WO | WO 2007/105843 | A1 | 9/2007 |
| WO | WO 2008/003592 | A1 | 1/2008 |
| WO | WO 2008/007888 | A2 | 1/2008 |
| WO | WO 2008/103007 | A2 | 8/2008 |
| WO | WO 2009/040302 | A1 | 4/2009 |
| WO | WO 2009/050095 | A1 | 4/2009 |
| WO | WO 2009/148251 | A2 | 12/2009 |

OTHER PUBLICATIONS

Chinese Office Action dated Mar. 28, 2013 issued in Application No. 201080021257.5 (with English translation).
Russian Decision to Grant a Patent dated May 15, 2014 issued in Application No. 2011147481 (with English translation).
United States Office Action dated Jun. 12, 2014 issued in U.S. Appl. No. 13/318,655.
United States Office Action dated Jun. 17, 2014 issued in U.S. Appl. No. 13/258,965.
International Search Report and Written Opinion dated Sep. 14, 2010 issued in Application No. PCT/KR2009/007869.
International Search Report and Written Opinion dated Oct. 27, 2010 issued in Application No. PCT/KR2010/003379.
International Search Report and Written Opinion dated Oct. 27, 2010 issued in Application No. PCT/KR2010/003400.
International Search Report and Written Opinion dated Nov. 24, 2010 issued in Application No. PCT/KR2010/003376.
International Search Report and Written Opinion dated Nov. 24, 2010 issued in Application No. PCT/KR2010/003377.
International Search Report and Written Opinion dated Nov. 24, 2010 issued in Application No. PCT/KR2010/003378.
International Search Report and Written Opinion dated Nov. 29, 2010 issued in Application No. PCT/KR2010/003404.
International Search Report and Written Opinion dated Nov. 29, 2010 issued in Application No. PCT/KR2010/003405.
International Search Report and Written Opinion dated Nov. 29, 2010 issued in Application No. PCT/KR2010/003409.
International Search Report and Written Opinion dated Nov. 29, 2010 issued in Application No. PCT/KR2010/003410.
International Search Report and Written Opinion dated Jan. 21, 2011 issued in Application No. PCT/KR2010/003406.
International Search Report and Written Opinion dated Jan. 31, 2011 issued in Application No. PCT/KR2010/003408.
International Search Report and Written Opinion dated Jul. 19, 2011 issued in Application No. PCT/KR2009/007963.
International Search Report and Written Opinion dated Sep. 21, 2011 issued in Application No. PCT/KR2009/007960.
European Search Report dated Jul. 31, 2012 issued in Application No. 09 83 6377.
United States Office Action dated Aug. 4, 2014 issued in U.S. Appl. No. 13/318,655.
United States Office Action dated Sep. 3, 2014 issued in U.S. Appl. No. 13/142,620.
United States Office Action dated Sep. 9, 2014 issued in U.S. Appl. No. 13/259,709.
United States Office Action dated Oct. 2, 2014 issued in U.S. Appl. No. 13/259,832.
Chinese Office Action dated Jun. 4, 2013 issued in Application No. 201080021259.4 (with English translation).
Chinese Office Action dated Jun. 4, 2013 issued in Application No. 201080022490.5 (with English translation).
United States Office Action dated Nov. 14, 2013 issued in U.S. Appl. No. 13/266,838.
Chinese Office Action dated Dec. 25, 2012 issued in Application No. 200980155851.0 (with English translation).
Chinese Office Action dated Dec. 28, 2012 issued in Application No. 200980155608.9 (with English translation).
European Office Action dated Jan. 2, 2014 issued in Application No. 10 780 822.2.
Russian Office Action dated Jan. 22, 2014 issued in Application No. 2011132074 (with English translation.).
Russian Office Action dated Jan. 30, 2014 issued in Application No. 2011147481 (with English translation).
European Office Action dated Feb. 5, 2014 issued in Application No. 10 780 817.2.
ABT-MAH2400WH.pdf, web page posted on www.abt.com on Mar. 2009; https:/ /web.archive.org/web/20090301015816/http:/ /www.abt.com/_product/17027/Maytag-MAH2400AWW.html; retrieved by Examiner on Mar. 19, 2015.
Maytag-MAH2004AWW.pdf, web page posted on www.maytag.com on May 2005; https:/ /web.archive.org/web/20050502164236/ http:/ /www.maytag.com/mths/products/product.jsp?model=MAH2400AWWW; retrieved by Examiner on Mar. 19, 2015.
Amazon-MAH2400AWW.pdf, web page posted on www.amazon.com on Mar. 2015; http:/www.amazon.com/Maytag-MAH2400AWWCompact-Front-Load-Capacity/dp/ 8000UVYEOM/ref=cm_cd_ql_qh_dp_t; retrieved by Examiner on Mar. 19, 2015.
U.S. Office Action for U.S. Appl. No. 13/319,167 dated Feb. 5, 2015.
U.S. Office Action for U.S. Appl. No. 13/143,032 dated Mar. 16, 2015.
U.S. Office Action for U.S. Appl. No. 13/259,016 dated Mar. 24, 2015.
U.S. Office Action for U.S. Appl. No. 13/318,549 dated Mar. 26, 2015.
U.S. Office Action for U.S. Appl. No. 13/320,697 dated Apr. 9, 2015.
United States Office Action dated Dec. 29, 2014 issued in U.S. Appl. No. 13/266,895.
United States Final Office Action dated Jan. 9, 2015 issued in U.S. Appl. No. 13/318,655.
United States Final Office Action dated Jan. 21, 2015 issued in U.S. Appl. No. 13/142,620.
Russian Decision to Grant a Patent dated Aug. 29, 2014 issued in Application No. 2011146320/12 (with English translation).
Russian Decision to Grant a Patent dated Aug. 29, 2014 issued in Application No. 2011147482/12 (with English translation).
United States Office Action dated Nov. 18, 2014 issued in U.S. Appl. No. 13/143,032.
United States Office Action dated Nov. 20, 2014 issued in U.S. Appl. No. 13/259,016.

(56) References Cited

OTHER PUBLICATIONS

U.S. Office Action issued in U.S. Appl. No. 13/259,754 dated May 6, 2015.
U.S. Final Office Action issued in U.S. Appl. No. 13/319,167 dated May 18, 2015.
U.S. Office Action issued in U.S. Appl. No. 13/143,032 dated Jun. 29, 2015.
U.S. Office Action issued in U.S. Appl. No. 13/318,655 dated Jun. 30, 2015.
U.S. Notice of Allowance issued in U.S. Appl. No. 14/173,892 dated Jul. 27, 2015.
U.S. Notice of Allowance issued in U.S. Appl. No. 14/173,948 dated Jul. 27, 2015.
U.S. Notice of Allowance issued in U.S. Appl. No. 14/173,908 dated Jul. 28, 2015.
U.S. Office Action issued in U.S. Appl. No. 14/173,928 dated Jul. 30, 2015.
U.S. Office Action issued in U.S. Appl. No. 13/142,620 dated Aug. 3, 2015.
U.S. Office Action for U.S. Appl. No. 13/259,016 dated Jun. 17, 2015
European Office Action issued in Application No. 13 198 681.2 dated Oct. 8, 2015.
Chinese Office Action issued in Application No. 201410148311.2 dated Sep. 2, 2015.
Chinese Office Action issued in Application No. 201410148938.8 dated Aug. 21, 2015.
Chinese Office Action issued in Application No. 201410149092.X dated Aug. 21, 2015.
Chinese Office Action issued in Application No. 201410148940.5 dated Aug. 25, 2015.
U.S. Office Action dated Sep. 3, 2015 issued in related U.S. Appl. No. 13/320,697.
U.S. Office Action dated Sep. 11, 2015 issued in related U.S. Appl. No. 13/319,167.
U.S. Final Office Action dated Sep. 11, 2015 issued in related U.S. Appl. No. 13/318,549.
U.S. Final Office Action dated Nov. 16, 2015 issued in related U.S. Appl. No. 13/142,620.
Final U.S. Office Action dated Jan. 6, 2016 issued in U.S. Appl. No. 13/259,016.
Final U.S. Office Action dated Feb. 23, 2016 issued in U.S. Appl. No. 13/320,697.
European Search Report dated Feb. 25, 2014 issued in Application No. 10 78 0803.2.
European Search Report dated Feb. 25, 2014 issued in Application No. 10 78 0805.7.
European Search Report dated Feb. 26, 2014 issued in Application No. 10 78 0804.0.
European Search Report dated Feb. 26, 2014 issued in Application No. 10 78 0806.5.
European Notice of Allowance dated Feb. 28, 2014 issued in Application No. 10 78 0823.0.
European Search Report dated Mar. 19, 2014 issued in Application No. 13 19 8677.0.
United States Office Action dated Apr. 11, 2014 issued in U.S. Appl. No. 13/320,697.
U.S. Appl. No. 13/142,620, filed Jun. 29, 2011.
U.S. Appl. No. 13/143,032, filed Jun. 30, 2011.
U.S. Appl. No. 13/258,965, filed Sep. 22, 2011.
U.S. Appl. No. 13/259,016, filed Sep. 22, 2011.
U.S. Appl. No. 13/259,709, filed Sep. 23, 2011.
U.S. Appl. No. 13/259,754, filed Sep. 23, 2011.
U.S. Appl. No. 13/259,832, filed Sep. 23, 2011.
U.S. Appl. No. 13/320,697, filed Nov. 15, 2011.
U.S. Appl. No. 13/319,167, filed Nov. 7, 2011.
U.S. Appl. No. 13/266,838, filed Oct. 28, 2011.
U.S. Appl. No. 13/318,549, filed Nov. 2, 2011.
U.S. Appl. No. 13/266,895, filed Oct. 28, 2011.
U.S. Appl. No. 13/318,655, filed Nov. 3, 2011.
U.S. Appl. No. 14/173,892, filed Feb. 6, 2014.
U.S. Appl. No. 14/173,908, filed Feb. 6, 2014.
U.S. Appl. No. 14/173,928, filed Feb. 6, 2014.
U.S. Appl. No. 14/173,948, filed Feb. 6, 2014.
U.S. Appl. No. 15/017,905, filed Feb. 8, 2016.

LAUNDRY MACHINE

CROSS-REFERENCE TO RELATED PATENT APPLICATIONS

This application is a U.S. National Stage Application under 35 U.S.C. §371 of PCT Application No. PCT/KR2009/007963, filed Dec. 30, 2009.

TECHNICAL FIELD

The present invention relates to a laundry machine.

Generally, laundry machines are categorized into washers and dryers. Such washers include pulsator type washing machines and drum type washing machines and washing machines having washing and drying functions. Here, dryers are electric appliances that dry washed washing objects (hereinafter, laundry), using hot air and the like.

BACKGROUND ART

Such a drum type washing machine includes a tub arranged horizontally therein and a drum arranged in the tub horizontally. Washing objects (hereinafter, laundry) are located within the drum and they are tumbled together with the rotation of the drum to be washed.

Here, the tub is employed to hold wash water and the drum to have laundry located therein only to be washed.

The drum is rotatably located in the tub.

A shaft is connected to a rear surface of the drum and the shaft receives a rotational force from a motor 480. As a result, the motor 480 is rotated to transmit its rotational force to the drum and the rotational force rotates the drum.

The drum is rotated during rinsing and drying-spinning cycles as well as a washing cycle and it is vibrated during its rotation.

The shaft is projected outside the tub, passing through a rear surface of the tub. The conventional washing machine would include a bearing housing insert-molded in the rear surface of the tub or a bearing housing secured to the rear wall surface of the tub.

The above bearing housing supports the shaft and the vibration of the drum is transmitted to the tub and the bearing housing via the shaft.

Because of that, the tub is vibrated together with the drum and a damping supporting material is connected to the tub to dampen such the vibration.

That is, the conventional laundry machine is structured to make the vibration of the drum transmitted to the tub directly as and to make the damping supporting material support connected to the support the vibration.

DISCLOSURE OF INVENTION

Technical Problem

The present invention provides a laundry machine that is different from the conventional laundry machine in an aspect of supporting a drum.

Especially, the laundry machine according to the present invention may include a new structure of supporting the vibration of the drum dampenedly, not transmitting it to the tub directly as it is according to the conventional laundry machine.

Solution to Problem

One embodied laundry machine may include a tub to hold water therein; a drum rotatably placed in the tub; a drive assembly comprising a shaft connected to the drum, a bearing housing rotatably supporting the shaft and a motor to rotate the shaft; and a suspension unit to reduce vibration of the drum.

The suspension unit may comprise a radial bracket which has a radially extended portion. Here, the motor may be connected with the shaft directly or indirectly.

The bearing housing and suspensions may be distant from each other with respect to a radial direction as well as an axial direction. As a result, the suspension unit may include a radial bracket extended radially or axial bracket extended axially.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made intergrally with the cabinet.

Next, the tub may be supported by being fastened by screws, ribets, rubber bushings, etc. Also, the tub may be welded or bonded to the cabinet. In this cases, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made intergally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects of Invention

The present invention disclosing the laundry machine has an industrial applicability. The laundry machine according to the present invention has a new supporting structure totally different from the structure of the conventional laundry machine. According to the embodiment to secure the tub to the cabinet, the tub may be enlarged close to be the inner surface of the cabinet. As a result, the size of the drum may be also enlarged and the laundry machine having the increased capacity may be enabled.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

Figure 1:
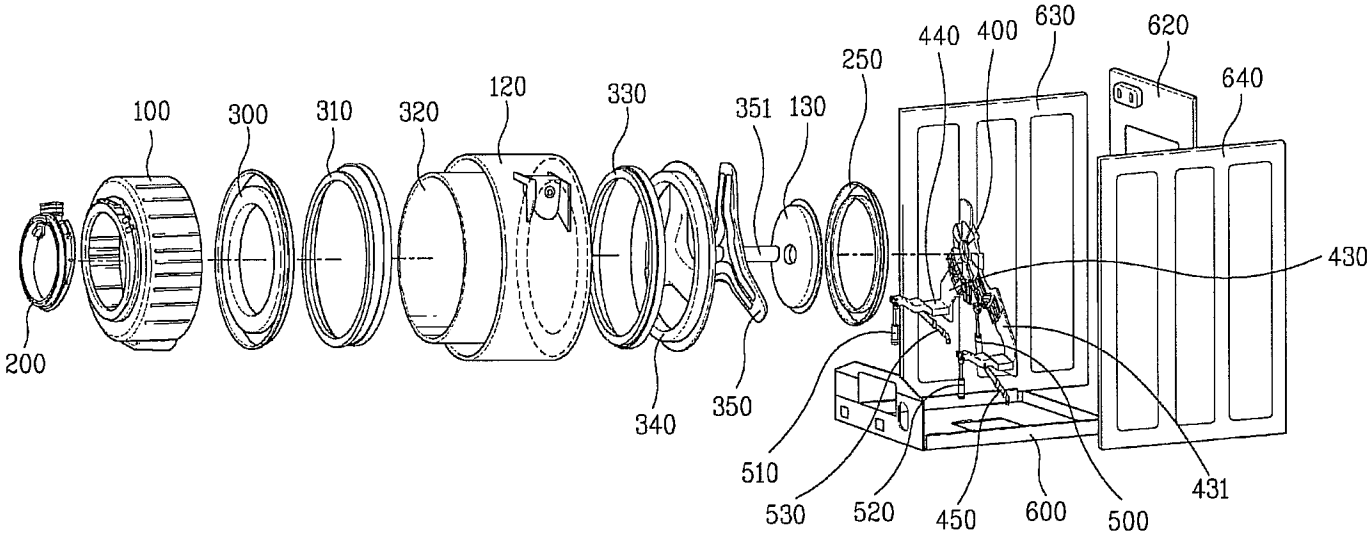
FIG. 1 is an exploded perspective view partially illustrating a laundry machine according to an exemplary embodiment of the present invention.

FIG. 1 is a partially perspective view illustrating a laundry machine according to an exemplary embodiment of the present invention.

The laundry machine includes a tub fixedly supported to a cabinet. The tub includes a tub front 100 defining a front portion thereof and a tub rear 120 defining a rear portion thereof.

The tub front 100 and the tub rear 120 may be assembled by a screw and a predetermined space is formed inside the assembly of the tub front and rear 100 and 120 to hold a drum. The tub rear 120 includes an opening formed in a rear portion thereof and the opening is connected to a rear gasket 250 that is a flexible member. The rear gasket 250 may be connected to a tub back 130 in its inner radial portion. A through hole is formed in a center of the tub back 130 and a shaft passes through the hole. The rear gasket 250 may be flexible enough not to transmit the vibration of the tub back 130 to the tub rear 120.

The rear gasket 250 is sealedly connected with the tub back 130 and the tub rear 120 such that wash water held in the drum may not leak. The tub back 130 is vibrating together with the drum when the drum is rotated and it is spaced apart a predetermine distance from the tub rear 120 enough to prevent interference with the tub rear 120. Since the rear gasket 120 is transformed flexibly, the tub back 130 is allowed to relatively move without interfering with the tub rear 120. The rear gasket 120 may include a curvature or wrinkle portion 252 extendible to a predetermined length enough to allow such the relative motion.

The tub includes an introduction opening formed in a front portion thereof to introduce laundry. A front gasket 200 may be installed in the front portion of the tub in which the introduction opening is formed to prevent the laundry or foreign substances from being stuck between the tub and the drum or to prevent wash water from leaking toward the introduction opening or to perform another function.

The drum includes a drum front 300, a drum center 320 and a drum back 340. A ball balancer may be installed in each of front and rear portions of the drum, respectively. The drum back 340 is connected to a spider 350 and the spider 350 is connected to the shaft 351. Here, the drum is rotatable within the tub by the rotational force transmitted via the shaft 351.

The shaft 351 is connected to a motor 480, passing through the tub back 130. According to this embodiment, the motor 480 is connected to the shaft in a concentric circle. That is, according to this embodiment, the motor 480, specifically, a rotor of the motor 480 is directly connected to the shaft 351. A bearing housing 400 is secured to a rear surface 128 of the tub back 130. The bearing housing 400 is provided between the motor 480 and the tub back 130 and it rotatably supports the shaft 351.

A stator of the motor 480 is fixedly secured to the bearing housing 400 and the rotor of the motor is located around the stator. As mentioned above, the rotor is directly connected to the shaft 351. Here, the motor 480 is an outer rotor type and it is directly connected to the shaft 351.

The bearing housing 400 is supported by a base 600 of the cabinet via a suspension unit. The suspension unit may include a plurality of brackets connected to the bearing housing and the suspension unit may include a plurality of suspensions connected to the plurality of the brackets.

According to this embodiment, the suspension may include three perpendicular suspension and two oblique suspensions installed oblique with respect to a forward/rearward direction. The suspension unit is connected to the cabinet base 600 not fixedly but flexibly enough to allow the drum to move in forward/rearward and leftward/rightward directions. That is, the suspension unit is supported by the cabinet base 600, with being flexible enough to allow a predetermined rotation forward/rearward and leftward/rightward with respect to the supported location. For such the flexible support, the suspension vertically installed may be installed in the base 600 by rubber-bushing. Predetermined ones of the suspensions installed vertically are configured to suspend the vibration of the drum flexibly and the other ones installed obliquely may be configured to damp the vibration. That is, in a vibrometer including a spring and damping means, the vertically installed ones are employed as spring and the obliquely installed ones are employed as damping means.

The tub is fixed to the cabinet and the vibration of the drum is suspended by the suspension unit. The front and rear portions of the tub may be fixed to the cabinet and the tub is seatedly supported by the cabinet base or fixed to the cabinet base.

The laundry machine according to this embodiment includes the supporting structure of the tub and that of the drum that are substantially independent. In addition, the laundry machine has the structure in which the tub is not vibrating during the vibration of the drum. Here, the quantity of vibration transmitted to the drum may be variable according to the rear gasket.

As the vibration of the tub is noticeably small in the laundry machine according to the present invention, the space maintained because of the vibration is unnecessary and thus an outer surface of the tub may be located close to the cabinet as much as possible. This enables the enlarged size of the tub, without the enlarged size of the cabinet, and also it enables the capacity of the laundry machine to be increased, in the same external size.

Substantially, the distance between a cabinet right 630 or a cabinet left 640 and the tub may be only 5 mm in the laundry machine according to this embodiment of the present invention. In contrast, the distance is 300 mm to prevent the vibration of the tub from interfering with the cabinet in the conventional laundry machine. Considering a diameter of the tub, the laundry machine according to this embodiment may lengthen the diameter of the tub by 500 mm in comparison with the conventional laundry machine. This results in noticeable difference enabling the capacity of the laundry machine to be one-stepped up in the identical external size.

Figure 2:
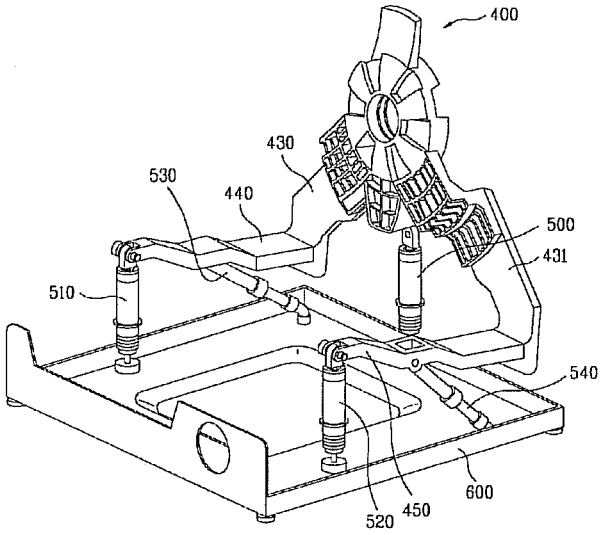
FIG. 2 is a diagram illustrating connection between a suspension unit and a bearing housing and between the bearing housing and a cabinet base.

FIG. 2 is a diagram illustrating the suspension unit installed on the base 600.

As shown in FIG. 2, the suspension unit includes a first suspension 520, a second suspension 510, a third suspension 500, a first damper 540 and a second damper 530.

The suspension is configured of a cylinder and a piston connected by a spring installed there between. The length of the suspension configured of the cylinder and piston is stably variable during the suspending. Such the suspension may be configured to have a damping effect as well. That is, the suspension may be made of a spring damper.

The first damper 540 and the second damper 530 may be made of simple dampers and they are not limited thereto. The first and second dampers may be made of spring dampers.

The first suspension 520 is connected between the first axial bracket 450 and the base 600. The second suspension is connected between the second axial bracket 440 and the base 600.

The third suspension 500 is directly connected between the bearing housing 400 and the base.

The suspensions 500, 510 and 520 are installed vertically and the first and second dampers are installed obliquely in a forward/rearward direction.

The third suspension 500 is installed in a center of the rear portion and the first and second suspensions 510 and 520 are in right and left sides of a front portion, respectively. The first and second dampers are installed between the third suspension 500 and the first and second suspensions 520 and 510, respectively, symmetrical-bilaterally.

The suspensions 500, 510 and 520 are connected to the base by rubber-bushing.

The bearing housing and the first suspension 520 and the second suspension 510 are distant from each other with respect to not only the axial direction but also the radial direction of the shaft 351. As a result, the suspension unit may include a radial bracket extended toward the radial direction and an axial bracket extended toward the axial direction.

Figure 3:
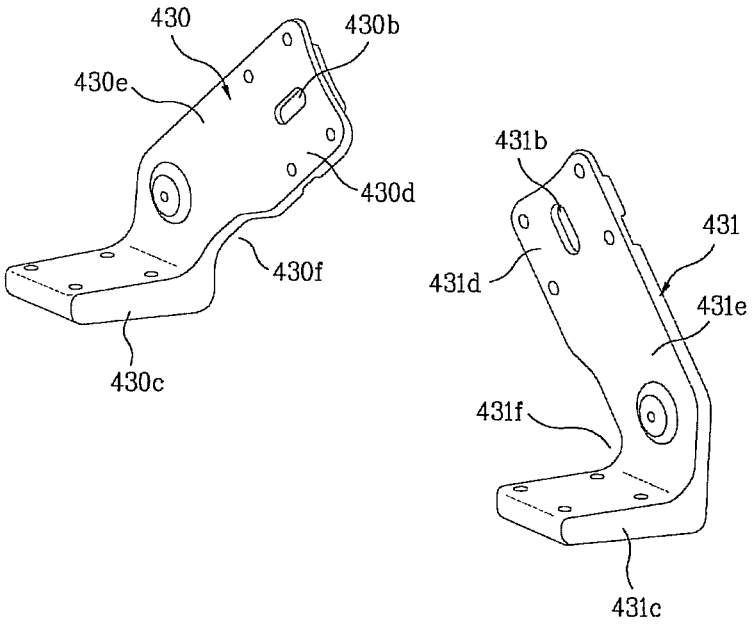
FIG. 3 is a diagram illustrating a radial bracket shown in FIG. 2.

FIG. 3 is a diagram illustrating the radial bracket more specifically. The first radial bracket 431 is connected to the left portion of the bearing housing 400 and the second radial bracket 430 is connected to the right portion of the bearing housing 400. The first and second radial brackets 431 and 430 are symmetrical to each other with respect to the axial direction.

The first and second radial brackets 431 and 430 are formed as weights and as bracket connecting the first and second axial brackets 450 and 440 to the bearing housing 400, respectively.

The first and second radial brackets 431 and 430 are extended toward a radial direction with respect to the shaft 351 and they are extended toward a forward reaction. A coupling hole is formed in an upper portion of each above weight to couple each weight is coupled to a corresponding weight coupling part. Four coupling holes are formed in each upper portion of the weights.

Position determining grooves 430*b* and 431*b* are formed in the radial brackets 431 and 430, respectively, to be inserted in the bearing housing.

Bracket connecting parts 430*c* and 431*c* are formed in the first and second radial brackets 431 and 430, respectively, to be connected to the first and second axial brackets. The bracket connecting part is heavier than the other parts of the weight. If a mass center of the weight is located downside, the weight may be stable against the vibration.

Such the first and second radial brackets 431 and 430 may be fabricated of iron by casting.

The first and second radial brackets 431 and 430 include first and second coupling parts 431*d* and 430*d* formed in the upper portions thereof to be connected with the bearing housing 400. The coupling parts 431*d* and 430*d* are fixedly coupled to first and second extended portions 406*a* and 406*b* of the bearing housing by coupling members, respectively. Here, when the first and second coupling parts 431*d* and 430*d* are coupled to the first and second extended portion 406*a* and 406*b* of the bearing housing 400, the angle between the first and second coupling parts 431*d* and 430*d* is maintained identical to the angle between the first and second extended portions 406*a* and 406*b*. For this coupling, the coupling holes are formed in the coupling parts 431*d* and 430*d* and each of the coupling holes 431*d* and 430*d* includes four coupling holes to secure the coupling rigidity. The motor 480 may be directly connected to the shaft. Here, the first and second coupling parts 431*d* and 430*d* may be coupled to the bearing housing, out of the radial direction with respect to the motor 480. For that, the first and second extended portions 406*a* and 406*b* may be extended from the stator coupling portion of the bearing housing where the stator of the motor 480 is coupled in the radial direction. The first and second extended portions 406*a* and 406*b* may be extended after bent toward an opposite direction of the drum from the outside of the radial direction with respect to the motor 480 and they may be re-extended in the radial direction.

The radial brackets 431 and 430 include middle portions 431*e* and 430*e* extended from the first and second coupling parts 431*d* and 430*d*, respectively. The middle portions 431*e* and 430*e* are located between the first and second coupling parts 431*d* and 430*d* and the bracket connecting parts 431*c* and 430*c*.

The middle portions 431*e* and 430*e* are spaced apart a predetermined distance rearward from the rear wall of the tub enough not to interfere with the rear wall because of the vibration of the drum during the operation of the laundry machine. The tub rear has a through hole formed in a center thereof, with a larger diameter than a diameter of the tub back. The rear gasket is sealed between the tub and the tub back.

The bracket connected portions 431*c* and 430*c* are extended forward from the middle portions 431*e* and 430*e*. The bracket connected portions 431*c* and 430*c* are located in an outer portion of the outer circumferential surface of the tub with respect to the radial direction. The bracket connected portions 431*c* and 430*c* may interfere with the rear wall of the tub. However, the bracket connection members are extended forwardly to be connected with the brackets 440 and 450 and thus they may be fabricated in consideration of the possibility of interference with the outer circumferential surface of the side of the tub.

The middle portions 431*e* and 430*e* are extended toward the radial direction, with maintaining the identical angle to the angle of the first and second coupling parts 430*d* and 431*d*, and they are curved downward to meet the bracket connected portions 4301*c* and 430*c*.

According to the above laundry machine, the vibration of the drum may be displaced larger in an upward/downward direction (that is, vertically) than in a rightward/leftward direction (that is, horizontally). If the displacement is lessened in the rightward/leftward direction during the vibration of the drum, the diameter of the drum may be enlarged. As a result, the capacity of the laundry machine may be enlarged and then the diameter of the door of the laundry machine may be enlarged.

The appearances and locations of the first and second axial brackets 450 and 440 may be designed not to interfere with the tub during the vibration. As the first and second axial brackets 450 and 440 receive a moment getting larger along the rear direction, rear portions of the first and second axial brackets 450 and 440 may be have larger rigidity and appearance than front portions thereof. Because of that, the rear portions of the first and second axial brackets 450 and 440 have larger external sections than the front portions thereof. The rear portions of the first and second axial brackets 450 and 440 may be disadvantageous in an aspect of interference with the tub, compared with the front portions. That is, the rear portions of the first and second axial brackets 450 and 440 needs to be distant from circumferential surfaces thereof enough to avoid the interference with an outer circumferential surface of the side wall of the tub. Here, the rightward/leftward direction width of the tub is getting larger upward from a lower portion with respect to a center of an approximately circular sectional view of the tub. As a result, it may be advantageous to locate the rear portions of the first and second axial brackets 450 and 440 in lower positions as possible to be distant from the tub. Considering that the vibration of the drum can be displaced more in the rightward/leftward direction than in the upward/downward direction, it is more advantageous to locate the rear portions in much lower positions. If a line having an angle of 45 degree with respect a vertical line passing the shaft of the drum is drawn in a rear view of the laundry machine, the rear portions of the first and second axial brackets 450 and 440 may be located under the above 45 degree-angled line advantageously. Here, angles (A1 and A2) shown in FIGS. 4 and 5 may be 45 degree.

Figure 4:
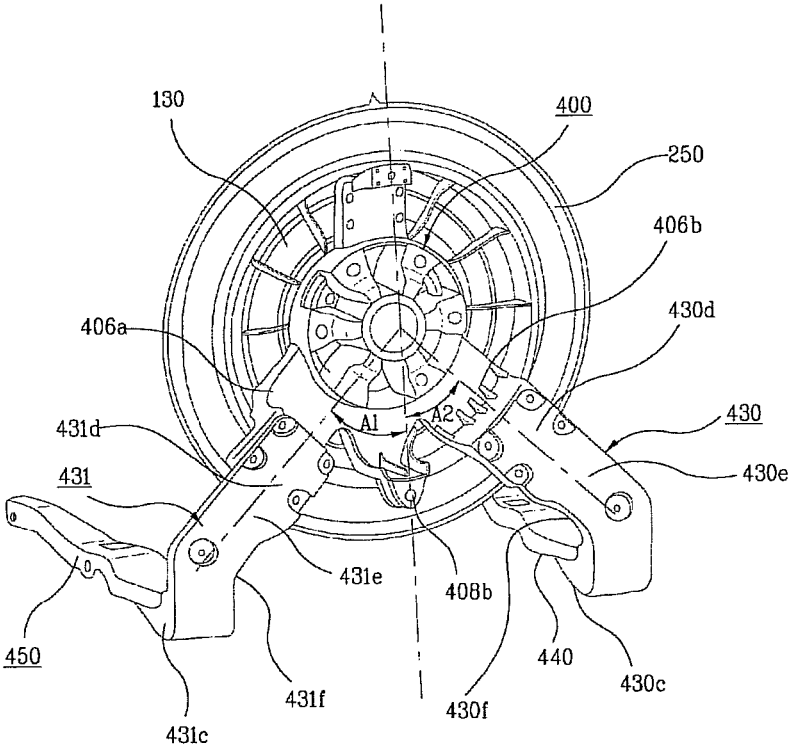
FIG. 4 is a diagram illustrating connection between the bearing housing and the radial bracket.
Figure 5:
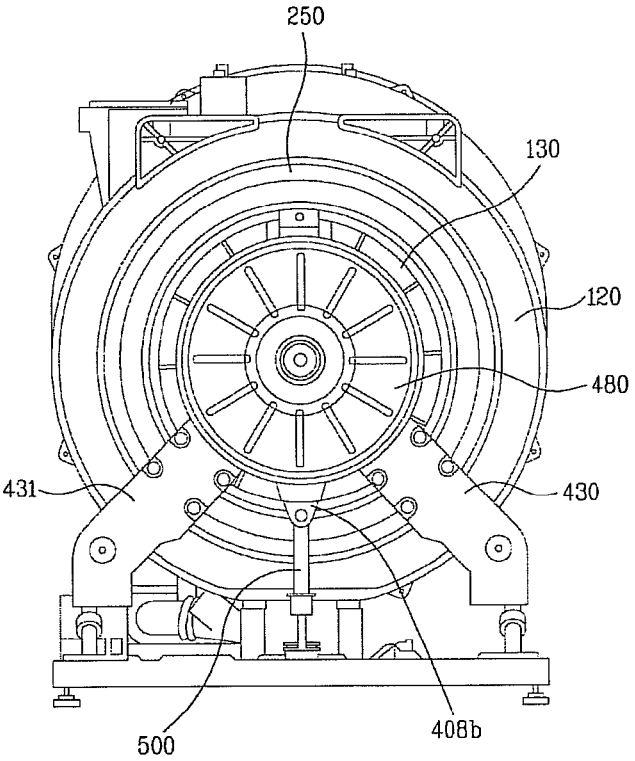
FIG. 5 is a partial rear-view of FIG. 4.

Positions of the bracket connected portions 430*c* and 431*c* of the radial brackets may be determined in consideration of the above configuration. The middle portions 430*e* and 431*e* of the radial brackets may be formed in consideration of the positions of the bracket connected portions 430*c* and 431*c*. Because of that, the middle portions 430*e* and 431*e* may have bent portions bent downward. That is, the first and second coupling parts 431*d* and 430*d* of the radial brackets may be coupled to the first and second extended portions 406*a* and 406*b* of the bearing housing in a straight line and the middle portions 430*e* and 431*e* may be extended radially in this straight line and then bent downward to meet the bracket connected portions 430*c* and 431*c* extended forward. As shown in FIG. 4, the middle portions 431*e* and 430*e* are substantially perpendicular-bent downward.

The bracket connected portions 430*c* and 431*c* are coupled to the axial brackets 450 and 440 by coupling members. For such the coupling, coupling holes are formed in the connected portions 430*c* and 431*c* and the coupling parts 431*d* and 430*d* may include four coupling holes to secure higher coupling rigidity.

In case the radial brackets are formed to be used as weights as well, the mass centers of the radial brackets may be located relatively in a rear portion, compared with the mass center of the assembly configured of the drum, spider, shaft, bearing housing, motor and the like (hereinafter, drum assembly). Once the laundry is introduced into the drum, rotation displacement may occur, with a front end of the drum falling down. Because of that, it is advantageous to locate the mass center of each weight in rear of the mass center of the drum such that such the rotation displacement may be prevented. The radial brackets may be heavier than the bearing housing. This may lower the mass center of the vibrating system to stabilize the system. At least overall weight of the couple of the radial brackets may be larger than the weight of the bearing housing.

The first and second extended portions 406*a* and 406*b* of the bearing housing and the rear portions of the first and second axial brackets 450 and 440 may have predetermined sizes of appearances that are determined in consideration of required strength and rigidity. At this time, the bearing housing may be aluminum group metal and the first and second axial brackets 450 and 440 may be steel group metal and thus the strength and rigidity of those metals may be considered. The first and second extended portions 406*a* and 406*b* may be formed larger than the width of the rear portions of the first and second axial brackets 450 and 440. The middle portions 430*e* and 431*e* of the radial brackets may have section reduced portions 430*f* and 431*f* in consideration of such the difference of the sectional size. The section reduced portions 430*f* and 431*f* may be provided in inner surfaces rather than outer surfaces of the middle portions such that the first and second axial brackets 450 and 440 may be located distant from the tub.

The first and second extended portions 406*a* and 406*b* of the bearing housing are extended vertically from the stator connected portion toward the radial direction. There is the largest moment in portions of the first and second extended portions 406*a* and 406*b* where the stator connected portion meets and concentration of stress caused by the moment has to be lessened for rigidity. FIG. 4 shows oblique angles (A1 and A2) of 45 degree with respect to a vertical center line, in consideration of the first and second extended portions 406*a* and 406*b* that are bilaterally symmetrical and a circular outer circumferential surface of the stator connected portion.

As a result, the angle between the first and second extended portions 406*a* and 406*b* and the angle between the first and second coupling parts 431*d* and 430*d* may be 90 degree corresponding to the sum of the above angles (A 1 and A2). The angles between the extended portions and between the coupling parts, that is, 90 degree may stabilize the suspension assembly structurally, compared with obtuse and acute angles.

Figure 6:
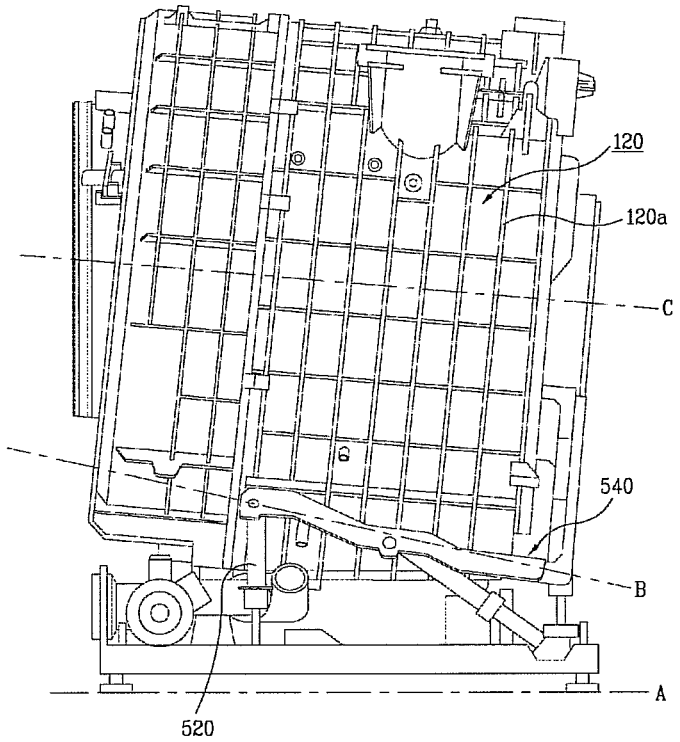
FIG. 6 is a side-sectional view of FIG. 5.

FIG. 6 is a side-sectional view illustrating the suspension unit installed together with the tub.

The brackets 450 and 440 are employed to support the first and second suspensions 510 and 520 and the first and second dampers 530 and 540 and they are not required to have heavy weights, different from the radial brackets 431 and 430. As a result, the brackets 450 and 440 may be formed of channel materials made of metal plates by pressing such that they may be lighter than the radial brackets 431 and 430.

In the meanwhile, the first suspension 520 is installed between a front end of the first axial bracket 450 and the base of the cabinet as shown in FIG. 6. The second suspension 510 is installed between a front end of the second axial bracket 440 and the base of the cabinet.

The first and second suspensions 520 and 510 should have enough lengths to have the required suspending capacity and thus the locations of the front ends of the first and second axial brackets 4450 and 440 may be determined in consideration of the length. The front ends of the first and second axial brackets may be installed higher than the rear ends thereof. In a side view of the tub, the tub may be installed obliquely with respect to a horizontal floor surface as shown in FIG. 6. That is, upper ends of the first and second suspensions 520 and 510 are located relatively higher than the connected portions 430*c* and 431*c* of the radial brackets. Because of that, the first and second axial brackets 450 and 440 may be arranged obliquely at a predetermined angle with respect to the horizontal surface, that is, the floor (A).

The drum is installed, with a front portion obliquely to be higher than a rear portion. The oblique angle of the drum may be different from the oblique angle of the first and second axial brackets 450 and 440. that is, as shown in FIG. 6, comparing a longitudinal center line (B) of the first and second axial brackets 450 and 440 with the rotational shaft (C) of the drum, the first and second axial brackets 450 and 440 may be arranged more obliquely than the drum, not in parallel to the drum.

The axial brackets may be designed to make the horizontal displacement of the drum smaller than the other direction displacement. For that, the sectional appearance of the axial bracket may be formed to make a sectional secondary moment with respect to the horizontal shaft smaller than a sectional secondary moment with respect to the vertical shaft. That is, the axial brackets may be designed to require less work in displacing the front ends thereof vertically than horizontally, in a state of being connected to the radial brackets. As the horizontal displacement of the drum is reduced as much as possible, the diameter of the drum may be enlarged only to increase the capacity. As a result, the diameter of the door of the laundry machine may be increased to improve visibility of the drum inside and convenience of laundry introduction/take-out.

INDUSTRIAL APPLICABILITY

The present invention disclosing the laundry machine has an industrial applicability. The laundry machine according to the present invention has a new supporting structure totally different from the structure of the conventional laundry machine. According to the embodiment to secure the tub to the cabinet, the tub may be enlarged close to be the inner surface of the cabinet. As a result, the size of the drum may be also enlarged and the laundry machine having the increased capacity may be enabled.

The invention claimed is:

1. A laundry machine comprising:

a cabinet;

a tub provided in the cabinet to hold water;

a drum rotatably provided in the tub, the drum having an opening to load the laundry therein, a front portion of the drum being higher than a rear portion of the drum;

a driving assembly including a shaft connected to the drum, a bearing housing to rotatably support the shaft, and a motor to rotate the shaft, wherein the bearing housing includes an extended portion that extends from the bearing housing in a radial direction of the bearing housing; and a suspension unit to reduce vibration of the drum, wherein the suspension unit includes:

a radial bracket that extends in the radial direction and is connected to the extended portion of the bearing housing, the radial bracket including a bracket connecting part that extends from an end of the radial bracket in the axial direction of the shaft, and an axial bracket that extends in the axial direction of the shaft and is connected to the bracket connecting part, and a suspension connected between the axial bracket and a base of the cabinet to suspend a vibration of the drum;

wherein the radial bracket is heavier than the bearing housing and the bracket connecting part is heavier than weight of other parts of the radial bracket for a mass center of the radial bracket being located downside, wherein a longitudinal center line of the axial bracket is arranged more obliquely than a rotational shaft of the drum.

2. The laundry machine as claimed in claim 1, wherein the motor is coaxially connected to the shaft, and the radial bracket is connected to the bearing housing at a location that is radially outside of the motor.

3. The laundry machine as claimed in claim 1, wherein the radial bracket extends radially outside of the tub.

4. The laundry machine as claimed in claim 1, wherein the radial bracket is bent downward.

5. The laundry machine as claimed in claim 4, wherein the radial bracket extends vertically from the bent portion.

6. The laundry machine as claimed in claim 1, wherein the radially extended portion is inclined at an angle of 40 degrees to 50 degrees with respect to a vertical line.

7. The laundry machine as claimed in claim 1, wherein the radial bracket has a portion at which a width is changed.

8. The laundry machine as claimed in claim 7, wherein a portion of the radial bracket at which the radial bracket is connected to the bearing housing is wider than a portion of the radial bracket at which the radial bracket is connected to the axial bracket.

9. The laundry machine as claimed in claim 1, wherein the radial bracket is made of iron by casting.

10. The laundry machine as claimed in claim 1, further comprising another radial bracket, and the radial bracket and the another radial bracket are provided opposite to each other with respect to the shaft.

11. The laundry machine as claimed in claim 1, further comprising:

a flexible material to prevent the water inside the tub from leaking toward the driving assembly and allow the driving assembly to move relatively to the tub.

12. The laundry machine as claimed in claim 1, wherein a first connection between the cabinet and the tub is more structural rigidly than a second connection between the drum and the suspension unit.

* * * * *